US007878122B2

(12) United States Patent
Mugnier

(10) Patent No.: US 7,878,122 B2
(45) Date of Patent: Feb. 1, 2011

(54) DEFORMABLE DRIVE SHEAVE

(75) Inventor: Jean-Francois Mugnier, Grand Junction, CO (US)

(73) Assignee: Leitner-Poma of America, Inc., Grand Junction, CO (US)

( * ) Notice: Subject to any disclaimer, the term of this patent is extended or adjusted under 35 U.S.C. 154(b) by 0 days.

(21) Appl. No.: 12/773,541

(22) Filed: May 4, 2010

(65) Prior Publication Data

US 2010/0213426 A1 Aug. 26, 2010

Related U.S. Application Data

(62) Division of application No. 11/670,789, filed on Feb. 2, 2007, now Pat. No. 7,743,711.

(60) Provisional application No. 60/780,634, filed on Mar. 8, 2006.

(51) Int. Cl.
*B61B 9/00* (2006.01)
*B60N 5/00* (2006.01)

(52) U.S. Cl. ..... 104/168; 105/323; 152/323; 152/326

(58) Field of Classification Search ..... 104/168, 104/178, 179, 180; 152/323, 326
See application file for complete search history.

(56) References Cited

U.S. PATENT DOCUMENTS 1,498,970 A * 6/1924 Kaufmann ..... 152/52
1,624,856 A * 4/1927 Bauman ..... 152/247
3,630,257 A * 12/1971 Goldberger ..... 152/301
4,226,273 A * 10/1980 Long et al. ..... 152/326
4,235,270 A * 11/1980 Kahaner et al. ..... 152/7
4,462,314 A * 7/1984 Kunczynski ..... 104/115
4,744,306 A * 5/1988 Kunczynski ..... 104/168
4,784,201 A * 11/1988 Palinkas et al. ..... 152/323
4,832,098 A * 5/1989 Palinkas et al. ..... 152/7
4,995,319 A * 2/1991 Mugnier ..... 104/112
5,159,880 A * 11/1992 Mugnier ..... 104/87
5,172,640 A * 12/1992 Cathiard ..... 104/173.2
5,188,037 A * 2/1993 Mugnier ..... 104/168
5,343,916 A * 9/1994 Duddey et al. ..... 152/5
5,690,031 A * 11/1997 Bach et al. ..... 104/168
6,332,406 B1 * 12/2001 Mugnier ..... 104/130.11
6,393,995 B1 * 5/2002 Mugnier ..... 104/173.1
6,427,601 B2 * 8/2002 Albrich ..... 104/87
6,431,080 B1 * 8/2002 Eisendle et al. ..... 104/178
6,467,519 B1 * 10/2002 Owen ..... 152/393
7,174,936 B2 * 2/2007 Becker et al. ..... 152/325
2006/0005903 A1 * 1/2006 Fry et al. ..... 152/1
2007/0034105 A1 * 2/2007 Mugnier ..... 104/178
2007/0227394 A1 * 10/2007 Mugnier ..... 104/180

* cited by examiner

*Primary Examiner*—S. Joseph Morano
*Assistant Examiner*—Jason C Smith
(74) *Attorney, Agent, or Firm*—Robert W. Nelson; Klaas, Law, O'Meara & Malkin, P.C.

(57) ABSTRACT

Drive sheaves are disclosed herein. An embodiment of a drive sheave includes a tire portion wherein the tire portion comprises an inner circumferential surface and an outer circumferential surface. The tire portion also includes a first surface extending between the inner circumferential surface and the outer circumferential surface and a second surface extending between the inner circumferential surface and the outer circumferential surface, the second surface being oppositely disposed relative to the first surface. At least one hole in the tire portion extends between the first surface and the second surface.

20 Claims, 5 Drawing Sheets

DEFORMABLE DRIVE SHEAVE

This application is a divisional application of Ser. No. 11/670,789 filed on Feb. 2, 2007, now U.S. Pat. No. 7,743,711 for DEFORMABLE DRIVE SHEAVE, which claimed the benefit of the U.S. provisional application 60/780,634 filed on Mar. 8, 2006, which are both hereby incorporated for all that is disclosed therein.

BACKGROUND

Aerial ropeway transport systems, such as gondolas and chairlifts, are commonly used for transporting people and cargo. A typical system has two end terminals or stations, each having a bull wheel for supporting a rope, such as a steel cable or the like. Rotation of the bull wheels causes the rope, and the carriers attached thereto, to move between the terminals.

In order to improve the efficiency of the system, the rope travels at a high velocity. In many embodiments, the rope velocity is too high for people and cargo to be loaded off and on the carriers. In such embodiments, the carrier detach from the rope when they are inside the terminals. After the carriers are detached, they move slowly through the terminal so that people or cargo can be loaded or unloaded.

As a carrier detaches from the rope, the carrier must be smoothly decelerated to a speed that enables the people or cargo to be loaded onto or unloaded from the carrier. In order to provide a smooth transition to the fast moving rope, the carrier needs to be accelerated to approximately the speed of the rope prior to being reattached to the rope. Rapid decelerations and accelerations of the carriers may injure people or damage cargo traveling in the carriers. Tires mounted on drive sheaves are typically used for the smooth acceleration and deceleration of the carriers. However, the tires are subject to significant wear and tear during the acceleration and deceleration of the carriers.

DETAILED DESCRIPTION

Figure 1:
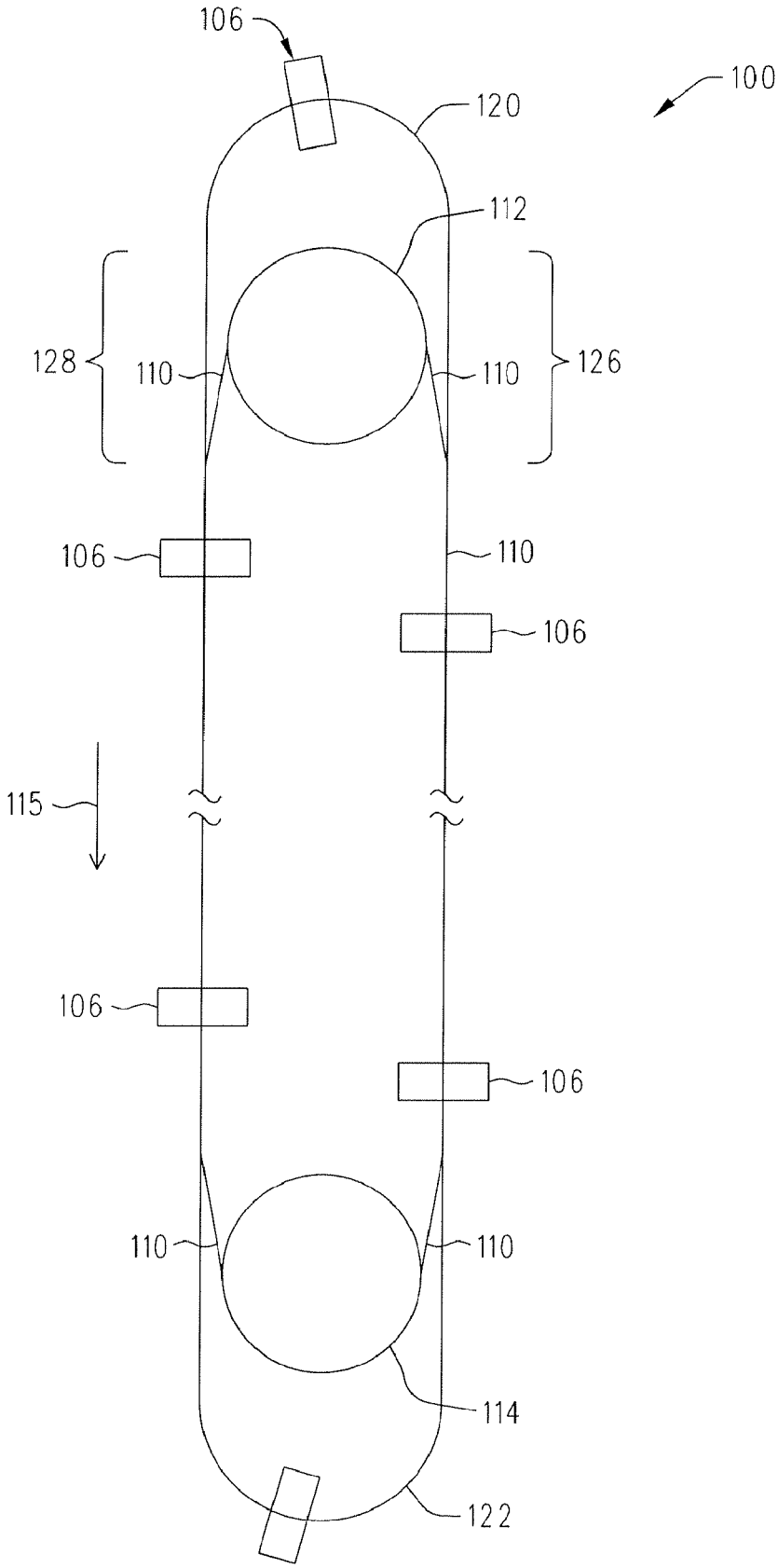
FIG. 1 is an embodiment of a tramway.

A top plan view of an embodiment of an aerial tramway or ropeway 100 is shown in FIG. 1. The ropeway 100 is used to move a plurality of carriers 106, such as chairs or gondolas. The ropeway 100 includes a continuous track-haul rope 110 extending between a first bull wheel 112 and a second bull wheel 114. In some embodiments, the ropeway may include a combination of segregated track and haul ropes. The first bull wheel 112 and devices associated therewith may be located in a first terminal, which may be, as an example, the base of a ski area. Likewise, the second bull wheel 114 may be located in a second terminal, which may be located at a higher elevation that the first terminal. The ropeway 100 may be used to transport skiers up a mountain. It is noted that the ropeway 100 may be used for purposes other than transporting skiers. For illustration purposes, the rope 110 is described herein as moving in a counter clockwise direction as indicated by the arrow 115. However, the rope may move in a clockwise direction in other embodiments.

As described in greater detail below, the carriers 106 are detachable from the rope 110. Detaching the carriers 106 enables them to move slowly so that people or cargo may be loaded onto and unloaded from the carriers 106. As shown in FIG. 1, the carriers may proceed on a first track 120 and a second track 122 when they are proximate the first and second bull wheels 113, 114 and detached from the rope 110. The first track 120 partially encompasses the first bull wheel 112 and the second track 122 partially encompasses the second bull wheel 114.

As described in greater detail below, the rope 110 moves at a high rate of speed, which is typically too fast for people and cargo to be loaded onto or unloaded from the carriers 106. When the carriers 106 move on the tracks 120, 122, their velocities are slow enough for people and cargo to be loaded onto or unloaded from the carriers. It follows that the carriers 106 must accelerate and decelerate while they are located on the tracks 120, 122. For illustration purposes, the first track 120 is defined as having three sections, a deceleration section 126, an acceleration section 128, and a loading/unloading section, which constitutes the remainder of the first track 120. When the carriers 106 are in the loading/unloading section, their velocities are maintained relatively constant. In some embodiments, the carriers 106 move 20 to 25 times faster when they are attached to the rope 110 than when they are slowed to a speed to enable people and cargo to be loaded and unloaded.

As the carriers 106 enter the first terminal or move proximate the first track 120, they detach from the rope 120. At the time of detachment, the carriers 106 are traveling at the velocity of the rope 110. The deceleration section 126 slows the carriers 106 to a velocity that enables people or cargo to be unloaded from and loaded into the carriers 106. The deceleration must occur in a manner that does not injure people or damage cargo located on the carriers. For example, the deceleration should be smooth and the rate of deceleration should not be great enough to injure people or damage cargo traveling in the carriers 106. The time the carriers 106 spend traveling in the load/unload section enables cargo and people to be loaded or unloaded from the carriers 106. The acceleration section 128 accelerates the carriers 106 to the velocity of the rope 110, so that they may be smoothly reattached to the rope 110. As with the deceleration, the acceleration should be smooth and the rate of acceleration should not injure people or damage cargo traveling in the carriers 106. The same process occurs with the second track 122.

Figure 2:
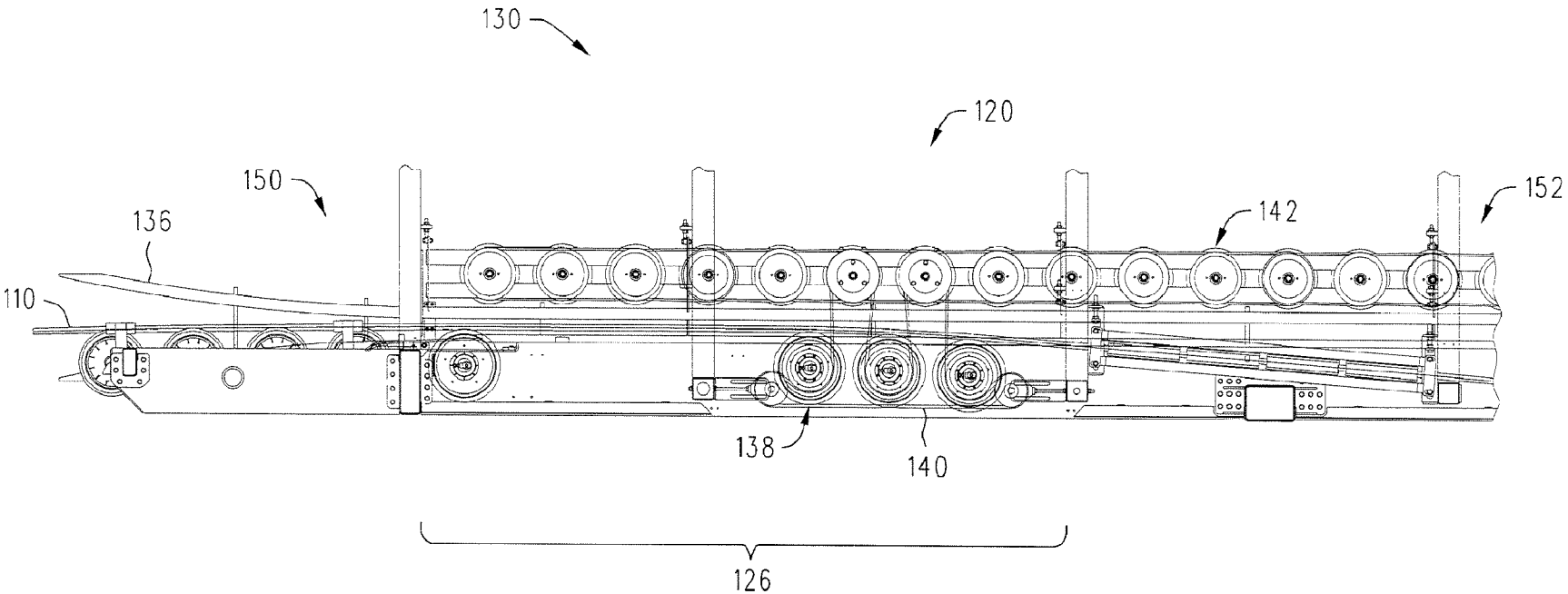
FIG. 2 is a side elevation view of an embodiment of a portion of a terminal used in the tramway of FIG. 1.

Having briefly described the operation of the ropeway 100, the operation of the first track 120 will now be described. FIG. 2 shows a side view of the first terminal 130, which includes the first track 120. The first track 120 includes a decoupling rail 136 that contacts a member (not shown) of the grips (not shown) of the carriers 106, FIG. 1. This contact causes the grips to open, which in turn causes the carriers 106 to detach from the rope 110 in a conventional manner. The decoupling rail 136 keeps the grips of the carriers 106 open during the period that the carriers are to be disconnected from the rope 110.

The first terminal 130 includes a plurality of drive sheaves used to move the carriers 106 along the first track 120. A first set of sheaves 138 contact the rope 110 and thus rotate by way of their contact with the rope 110. This first set of sheaves 138 is sometimes referred to as power take off sheaves. A belt 140 or the like connects the power take off sheaves 138 to a plurality of drive sheaves 142 that serve to decelerate, accelerate, and move the carriers when they are located on the first track 120. Therefore, the speed at which the drive sheaves 142 rotate is proportional to the speed of the rope 110. It is noted that in other embodiments, the power take off sheaves 138 and the drive sheaves 142 may be driven by mechanisms not associated with or connected to the rope 110.

For reference purposes, the speed of the carriers is fastest when they are located proximate a first end 150 of the first track 120 and slowest when they are located proximate a second end 152 of the first track 120. It follows that the carriers move fastest just after they are released from the rope 110. Likewise, the carriers 106 are also moving fastest just before they reattach to the rope 110. In the embodiment of the first track 120 described in FIG. 2, the carriers 106 move slowest when they are proximate the second end 152 of the first track 120. This is the location where people and/or cargo are loaded or unloaded from the carriers 106.

In order to smoothly accelerate and decelerate the carriers, the speeds that the different drive sheaves 142 rotate are different between the first end 150 and the second end 152 of the first track 120. The differing rotational speeds of the drive sheaves 142 accelerate or decelerate the carriers 106 in a manner that prevents damage to cargo or injury to people being transported by the carriers 106. As described in greater detail below, at least some of the tires of the drive sheaves 142 described herein are deformable so that they will undergo minimal wear and provide smooth operation when they are accelerating and decelerating the carriers 106.

Figure 3:
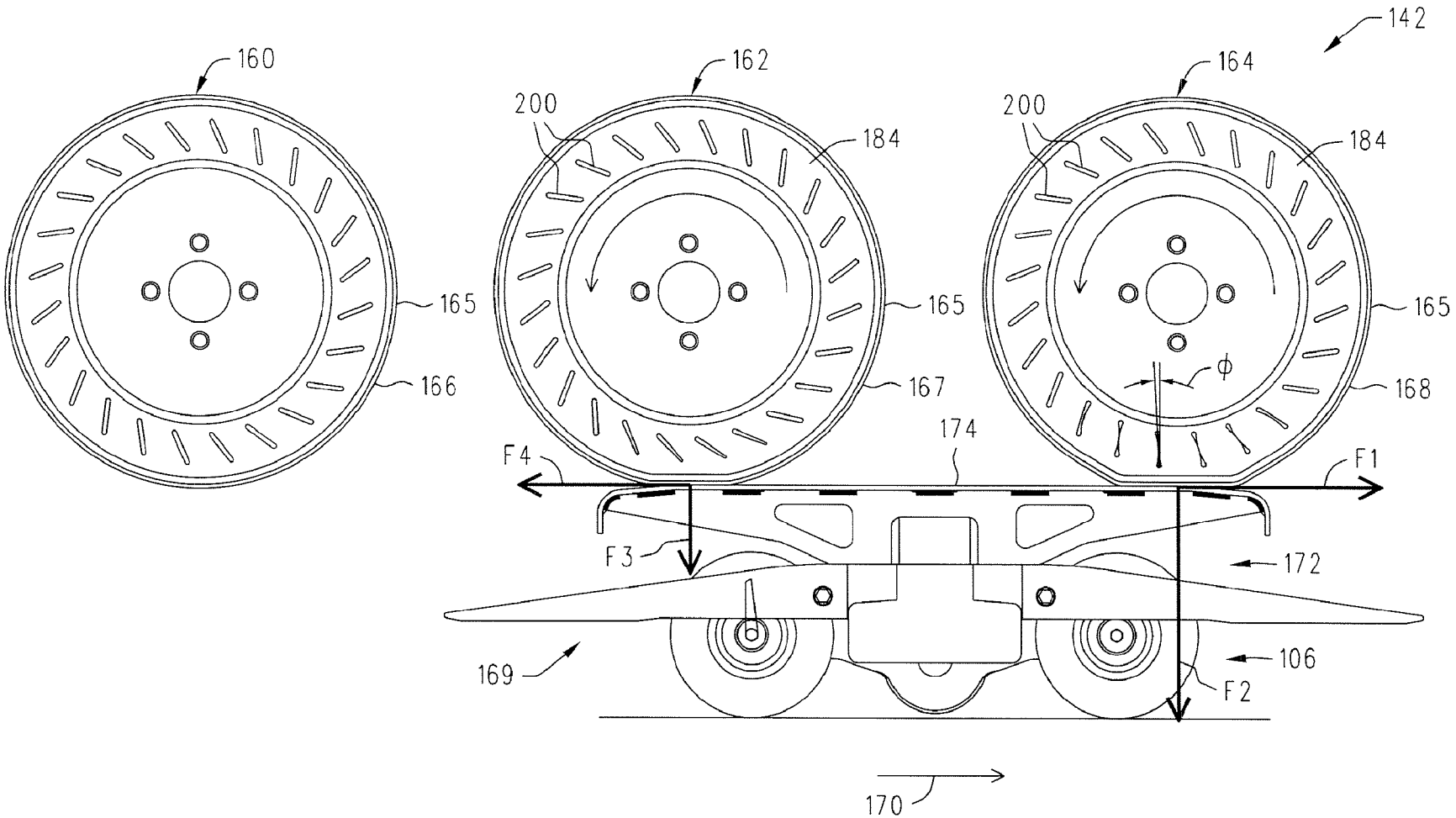
FIG. 3 is an embodiment of three drive sheaves in a terminal accelerating a carrier.

FIG. 3 is provided to describe the acceleration of the carriers using the drive sheaves 142. In the embodiment of FIG. 3, the carrier 169 is moving in the direction 170 and it is accelerating. For illustration purposes, three drive sheaves are shown in FIG. 3 and are referred to individually as the first drive sheave 160, the second drive sheave 162, and the third drive sheave 164. Tires 165 are outfitted onto the sheaves 142. A first tire 166 is outfitted on the first drive sheave 160, a second tire 167 is outfitted on the second drive sheave 162, and a third tire 168 is outfitted on the third sheave 164.

For illustration purposes, only the grip section 172 of a carrier 169 is shown in FIG. 3. The grip section 172 includes a friction plate 174 that contacts the drive sheaves 142. The friction plate 174 is long enough so as to contact two of the drive sheaves 142. It is noted that the friction plate 174 is in contact with a single drive sheave during longer periods than it is in contact with two drive sheaves.

Conventional tramways that use drive sheave to accelerate or decelerate carriers undergo wear and tear on the tires outfitting the drive sheaves. As a friction plate contacts drive sheaves rotating at different speeds, the drive sheaves slip relative to the friction plate, which is similar to skidding. The slipping wears the tires and creates excessive noise.

As described in greater detail below, the tires 165 on the drive sheave 142 described herein are slotted so as to be deformable. More specifically, the tires 165 are more easily deformable in one direction than the other and may be unidirectional. The deformability of the tires 165 either reduces or increases the friction or slippage between the friction plate 174 and the drive sheaves 142, depending on the circumstances. As described in greater detail below, the reduced slipping of the faster drive sheave improves its driving force and reduces the wear on the tires 165 during acceleration and deceleration of the carriers 106. The increased slipping of the slower drive sheave allows the faster drive sheave to accelerate or decelerate the carrier without having to fight the opposite forces resulting from the action of the slower drive sheave. In addition, the noise created by the interaction between the tires 165 of the drive sheave 142 and the friction plate 174 is also reduced.

Figure 4:
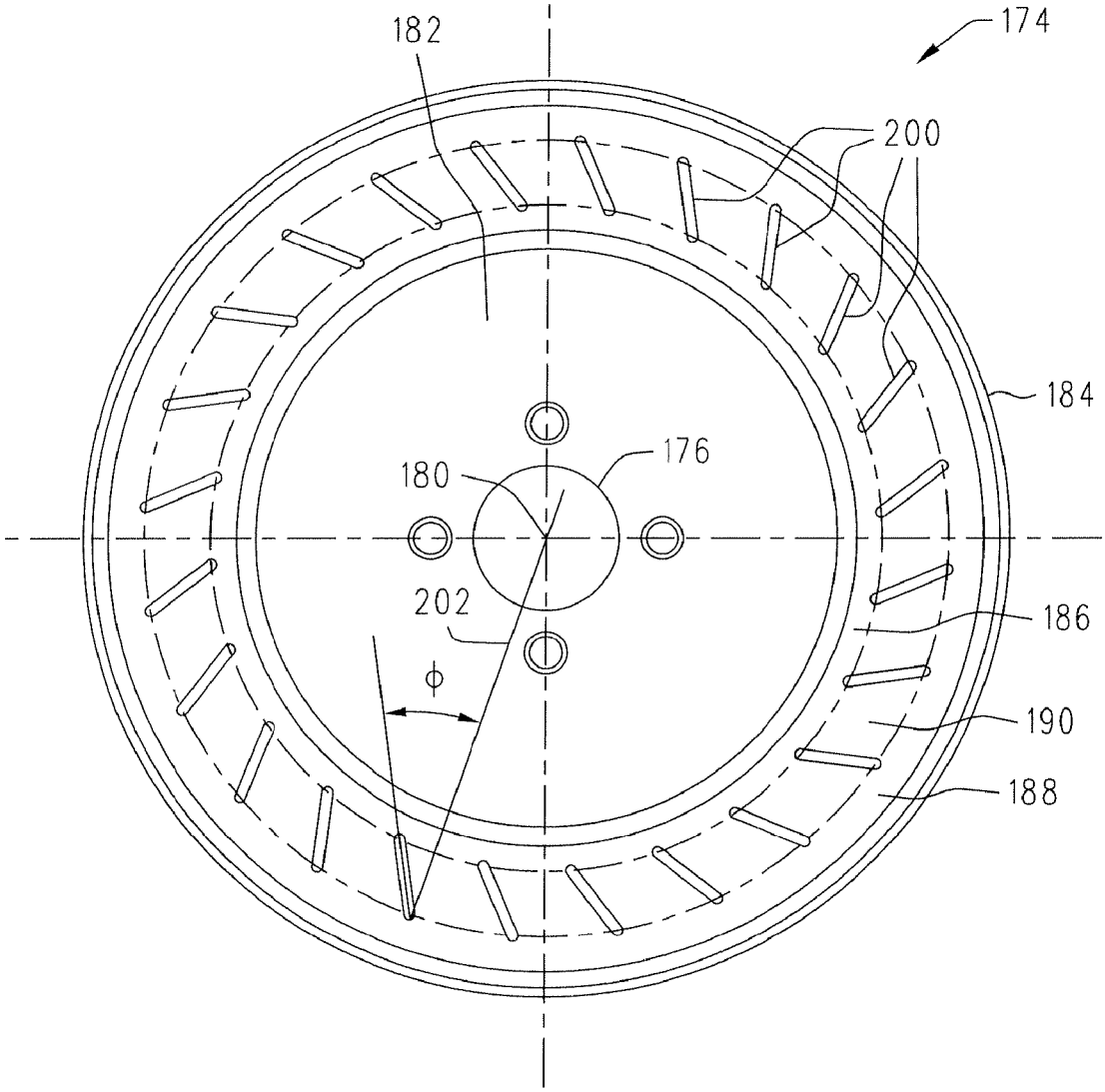
FIG. 4 is an enlarged view of an embodiment of a drive sheave equipped with an deformable tire.

An embodiment of a drive sheave 174 is shown in FIG. 4. It is noted that the drive sheave 174 is an example of the drive sheaves 142 of FIG. 3. Except for slots in the tire described in greater detail below, the embodiment of the drive sheave 174 described herein is similar to a conventional drive sheave having a solid tire mounted thereto. The embodiment of the drive sheave 174 includes an opening 176 that facilitates the mounting of the drive sheave 174 on an axle or the like. For references purposes, the drive sheave 174 includes a center point 180, which is the center of rotation for the drive sheave 174. Adjacent the opening 176 is a rigid rim 182.

A tire 184 is mounted to the rim 182 in a conventional manner. The tire 184 corresponds to the tires 165 of FIG. 3. Except for the slots described herein, the tire 184 is a solid tire, meaning that it is not pressurized with air. The tire 184 includes an inner circumferential portion 186, an outer circumferential portion 188, and a middle circumferential portion 190 located between the inner circumferential portion 186 and the outer circumferential portion 188.

A plurality of slots 200 extend through the middle circumferential portion 190. Although slots are shown and described as extending through the middle circumferential portion 190, other shaped holes may be used instead of slots. The slots 202 extend at an angle N from a radial line 202, which extends through the center of the drive sheave 174. In some embodiments, the angle N is approximately twenty-three degrees. However, the angle N may be changed depending on design characteristics, the material used for the tire 184 and the applications of the drive sheave 174. The slots 200 enable the tire 184 to deform, which as described below, reduces the wear on the tires 184. The deformation also increases or decreases driving force of the tire 184 on the friction plate 174, FIG. 3, of the grip 172, depending on the circumstances.

With addition reference to FIG. 3, when the carrier 169 is propelled by the drive sheaves 142, the speed of the carrier 169 is based on the fastest drive sheave contacting the friction plate 174. This mechanism is described in greater detail below. In the embodiment of FIG. 3, the friction plate 174 is contacting the second drive sheave 162 and the third drive sheave 164. More specifically, the second tire 167 and the third tire 168 are contacting the friction plate 174. The carrier 169 is accelerating in the direction 170 and is, thus, being pulled or accelerated by the third drive sheave 164. Therefore, the speed of the accelerating carrier 169 is governed by the speed at which the third drive sheave 164 rotates, because the third sheave 164 is the faster of the two.

As shown in FIG. 3, the tires 184 of the second drive sheave 162 and the third drive sheave 164 have deformed. The third drive sheave 164 is accelerating the carrier 169, so it is applying a force F1 in the direction 170. The deformation of the tire 184 of the third drive sheave 164 has caused the diameter of the third tire 168 to increase proximate the friction plate 174. As shown in FIG. 3, the angle N has decreased due to the force applied to the third tire 168 and the pliability of the third tire 168. The deformation of the third tire 168 also creates a force F2 that is perpendicular to the direction 170 and is applied to the friction plate 174. It is noted that the greater the force F2, the greater the friction between a drive sheave (or its associated tire) and the friction plate 174.

FIG. 3 illustrates the friction plate 174 being contacted by both the second drive sheave 162 and the third drive sheave 164. As described above, the deformation of the third tire 168 has increased the friction between the third drive sheave 164 and the friction plate 174. The deformation is due to the angle N of the slots 200 decreasing. The forces applied to the second drive sheave 162 cause the second tire 167 to deform in a manner that reduces its radius proximate the friction plate 174. As shown in FIG. 3, because the second drive sheave 162 is rotating slower than the third drive sheave 164, the angle N increases, which reduces the radius of the second tire 167 proximate the friction plate 174. It follows that a force F3 exerted on the friction plate 174 by the second drive sheave 162 in a direction parallel to the force F2 is less than the force F2. Therefore, the force F1 exerted by the third drive sheave 164 to move the carrier 169 in the direction 170 exceeds a counter force F4 exerted by the slower second drive sheave 162. Based on the above-described forces, the grip 172 and the carrier 169 move in the direction 170 and the speed is governed by the speed of the faster drive sheave, which is the third drive sheave 164.

As described above, the speed of the carrier 169, including the grip 172 and the friction plate 174, is governed by the speed of the third drive sheave 164, which is rotating faster than the second drive sheave 162. The second tire 167 deforms, which reduces the force it exerts on the friction plate 174. This reduction in force reduces the friction between the second drive sheave 162 and the friction plate 174. Therefore, the second drive sheave 162 and the friction plate 174 may slide relative to one another. Because there is reduced friction between the friction plate 174 and the second drive sheave 162, the wear on the second tire 167 is also reduced, which enables the second drive sheave 162 to last longer.

The same applies to the third drive sheave 164. Because the force exerted by the second drive sheave 162 on the friction plate 174 is reduced, the there is less skidding and less wear on third tire 168 of the the third drive sheave 164. The reduced skidding also reduces the noise associated with acceleration and deceleration of the carrier 169.

Figure 5:
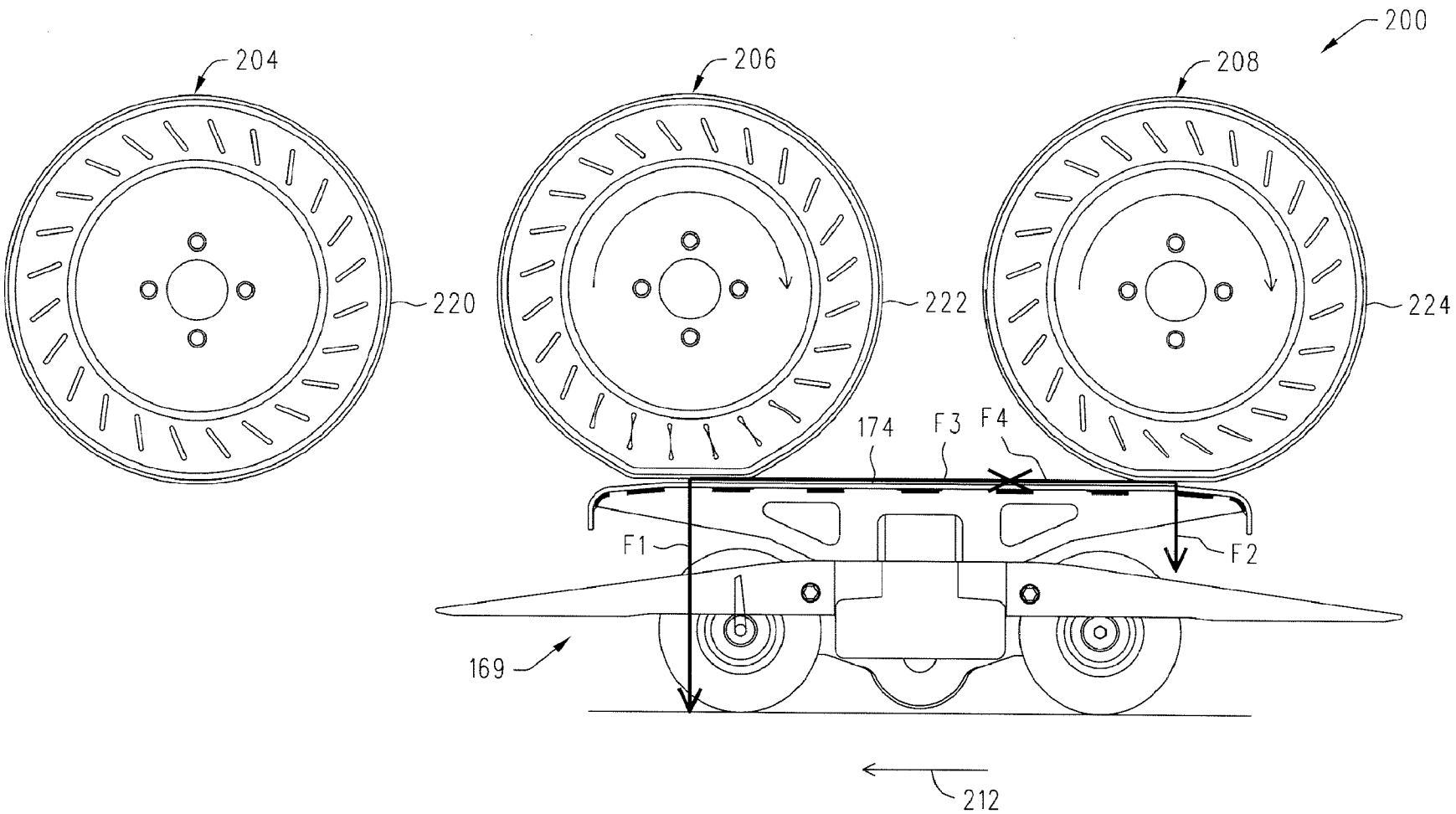
FIG. 5 is an embodiment of three drive sheaves in a terminal decelerating a carrier.

The opposite of the described functions occur when the carrier 169 decelerates. FIG. 5 shows a portion of a terminal used to decelerate the carrier 169. FIG. 5 shows three drive sheaves 200 that are referred to individually as the first drive sheave 204, the second drive sheave 206, and the third drive sheave 208. The carrier of FIG. 5 is decelerating in the direction shown by the arrow 212. Because the drive sheaves 200 are used to decelerate the carrier 169, the first drive sheave 204 rotates the slowest. The second drive sheave 206 rotates faster than the first drive sheave 204. The third drive sheave 208 rotates faster than the second drive sheave 206.

A first tire 220 is outfitted to the first drive sheave 204. Likewise, a second tire 222 is outfitted to the second drive sheave 206 and a third tire 224 is outfitted to the third drive sheave 208. The tires 220, 222, 224 are the same as the tire 184 described in FIG. 4. Only the second tire 222 and the third tire 224 are contacting the friction plate 174 in FIG. 5.

During deceleration, the speed of the carrier 169 is governed by the speed of the slowest sheave contacting the friction plate 174. The second tire 162 has deformed so as to increase its radius of the second drive sheave 206 proximate the friction plate 174. More specifically, the angle N of the second tire 222, as referenced by the tire 184 of FIG. 4, has decreased as a result of the deceleration forces and its diameter has increased. The radius of the third drive sheave 208 proximate the friction plate 174 has decreased as a result of the deceleration forces and the increase of the angle N.

Based on the foregoing, the force F1 exerted on the friction plate 174 by the second tire 222 is greater than the force F2 exerted by the third tire 224. Thus, the force F3 exerted by the second drive sheave 206 to decelerate the carrier 169 is greater than the counter force F2 exerted by the third drive sheave 208. As result of the above-described forces, the speed of the carrier 169 is governed by the speed of the slower tire, which is the second tire 222. The third tire 224 deforms as described above, which reduces the wear on the third tire 224 and the noise associated with its operation.

What is claimed is:

1. A drive sheave comprising:

a tire portion, said tire portion comprising:

an inner circumferential surface and an outer circumferential surface;

a first surface extending between said inner circumferential surface and said outer circumferential surface;

a second surface extending between said inner circumferential surface and said outer circumferential surface, said second surface being oppositely disposed relative to said first surface; and at least one hole in said tire portion extending through said first surface and said second surface.

2. The drive sheave of claim 1, wherein said hole is elongated.

3. The drive sheave of claim 2, wherein the elongated hole extends at an angle from a radius of said drive sheave, said radius extending from the center of said drive sheave.

4. The drive sheave of claim 3, wherein said angle is approximately twenty-three degrees.

5. The drive sheave of claim 2, wherein said angle increases when said outer circumferential surface exerts a force in a first direction and wherein said angle decreases when said outer circumferential surface exerts a force in a second direction opposite said first direction.

6. The drive sheave of claim 1, wherein the elongated hole extends at an angle from a radius of said drive sheave, said radius extending from the center of said drive sheave, and wherein said elongated hole extends from proximate said inner circumferential surface toward said outer circumferential surface.

7. The drive sheave of claim 1, wherein said outer circumferential surface is configured to contact at least a portion of a tram.

8. The drive sheave of claim 7, wherein said rope supports carriers on a tramway.

9. The drive sheave of claim 1, wherein said tire portion is pliable.

10. A drive member rotatably mounted about an axis of rotation, said drive member comprising:

a central portion;

a tire portion surrounding said central portion;

said tire portion comprising an inner circumferential surface adjacent said central portion and an outer circumferential surface located opposite said inner circumferential surface;

said tire portion comprising a first surface extending between said inner circumferential surface and said outer circumferential surface;

said tire portion comprising a second surface extending between said inner circumferential surface and said outer circumferential surface, said second surface being oppositely disposed relative to said first surface; and at least one hole in said tire portion extending through said first surface and said second surface.

11. The drive member of claim 10, wherein said hole is elongated.

12. The drive member of claim 11, wherein the elongated hole extends at an angle from a radius of said central portion, said radius extending from the center of said central portion.

13. The drive member of claim 12, wherein said angle is approximately twenty-three degrees.

14. The drive member of claim 10, wherein said tire portion is pliable.

15. The drive member of claim 12, wherein said angle increases when said outer circumferential surface exerts a force in a first direction and wherein said angle decreases when said outer circumferential surface exerts a force in a second direction opposite said first direction.

16. The drive member of claim 10, wherein said outer circumferential surface is configured to contact a rope.

17. The drive member of claim 16, wherein said rope supports carriers on a tramway.

18. A drive sheave comprising:

a tire portion;

said tire portion comprising an inner circumferential surface and an outer circumferential surface, said outer circumferential surface being configured to contact a rope;

said tire portion comprising a first surface extending between said inner circumferential surface and said outer circumferential surface;

said tire portion comprising a second surface extending between said inner circumferential surface and said outer circumferential surface, said second surface being oppositely disposed relative to said first surface; and at least one elongated hole in said tire portion extending through said first surface and said second surface, wherein the elongated hole extends at an angle from a radius of said drive sheave, said radius extending from the center of said drive sheave.

19. The drive sheave of claim 18, wherein said angle is approximately twenty-three degrees.

20. The drive sheave of claim 19, wherein said angle increases when said outer circumferential surface exerts a force in a first direction and wherein said angle decreases when said outer circumferential surface exerts a force in a second direction opposite said first direction.

* * * * *

UNITED STATES PATENT AND TRADEMARK OFFICE

CERTIFICATE OF CORRECTION

PATENT NO. : 7,878,122 B2
APPLICATION NO. : 12/773541
DATED : February 1, 2011
INVENTOR(S) : Mugnier It is certified that error appears in the above-identified patent and that said Letters Patent is hereby corrected as shown below:

IN THE SPECIFICATION

Column 1, Line 47, delete “an” and insert therefor --a--

Column 1, Line 64, delete “that” and insert therefor --than--

Column 4, Line 12, delete “references” and insert therefor --reference--

Column 4, Line 37, delete “addition” and insert therefor --additional--

Column 5, Line 31, after “reduced,” delete “the”

Column 5, Line 32, delete second occurrence of “the”

Signed and Sealed this
Seventeenth Day of September, 2013

Teresa Stanek Rea
*Deputy Director of the UnitedStates Patent and Trademark Office*